US006435900B1

(12) United States Patent
Olejarz et al.

(10) Patent No.: US 6,435,900 B1
(45) Date of Patent: Aug. 20, 2002

(54) CONDUCTOR-CONNECTING ELEMENT

(75) Inventors: Klaus Olejarz; Martin Schmidt, both of Löhne (DE)

(73) Assignee: Harting KGAA (DE)

( * ) Notice: Subject to any disclaimer, the term of this patent is extended or adjusted under 35 U.S.C. 154(b) by 0 days.

(21) Appl. No.: 09/935,850

(22) Filed: Aug. 23, 2001

(30) Foreign Application Priority Data

Sep. 29, 2000 (DE) ..... 100 48 298

(51) Int. Cl.[7] ..... H01R 4/24
(52) U.S. Cl. ..... 439/417; 439/397
(58) Field of Search ..... 495/395–412

(56) References Cited

U.S. PATENT DOCUMENTS 4,340,270 A * 7/1982 Wilmes et al. ..... 439/397
4,449,777 A * 5/1984 Baribeau ..... 439/403
4,652,071 A * 3/1987 Debortoli et al. ..... 439/403
4,764,125 A * 8/1988 Debortoli ..... 439/403
4,793,822 A * 12/1988 Cozzens et al. ..... 439/397
5,149,278 A * 9/1992 Waas et al. ..... 439/412
5,203,716 A * 4/1993 Martucci et al. ..... 439/411
5,601,448 A * 2/1997 Poon ..... 439/417

FOREIGN PATENT DOCUMENTS

EP 0 554 810 7/2001 ..... H01R/12/08

* cited by examiner

*Primary Examiner*—P. Austin Bradley
*Assistant Examiner*—Briggitte R. Hammond
(74) *Attorney, Agent, or Firm*—Hayes Soloway P.C.

(57) ABSTRACT

For the separable connection of an electrical conductor with a large cross-section to an insulation displacement connection, it is proposed that a connecting body with at least one insulation displacement terminal into which an electrical conductor can be forced by means of a clamping screw, be provided in a conductor-connecting element.

47 Claims, 3 Drawing Sheets

CONDUCTOR-CONNECTING ELEMENT

Figure 1A:
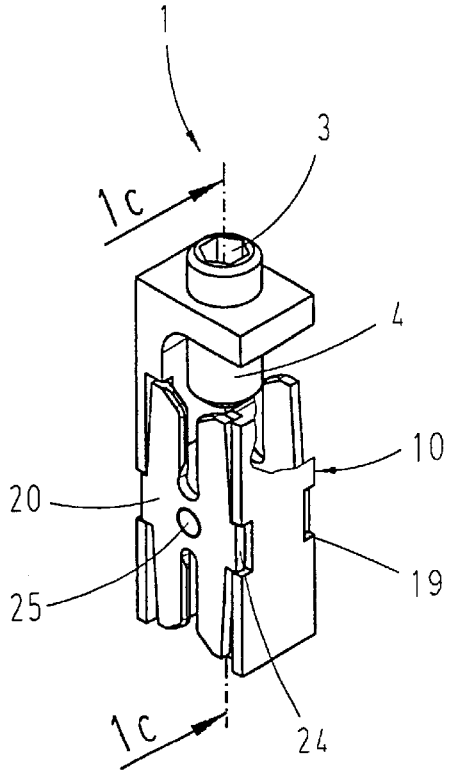

The invention relates to a conductor-connecting element for the connection of electrical conductors, preferably for conductors with large conducting cross-sections.

A conductor-connecting element of this kind is used for the separable connection, which is to be performed in a rapid and simple manner, of electrical conductors to electrical insulation displacement contacts.

From EP 554 810 A2, an electrical plug connector for connecting insulated electrical conductors is known, in which the electrical conductors are pushed into bores in a conductor-guiding element which have a double deflection, and contact with the said conductors is made within the deflection by means of insulation displacement terminals.

In the known connections using insulation displacement terminals, the fact that simple insulation displacement contacts are able to transmit only limited current intensities because of the small areas of contact between the electrical conductors and the narrow cutting edges of the contacts, has an unfavorable effect.

The underlying object of the invention is therefore to construct a conductor-connecting element of the initially mentioned type to the effect that a simple fitting and connection of electrical conductors is made possible, which is-so capable of transmitting high currents.

This object is achieved through the fact that a connecting body is provided in which a U-shaped conductor-receiving chamber is constructed, that a threaded bore into which a clamping screw can be screwed is provided in the said connecting body, that the connecting body is provided with at least one insulation displacement terminal, and that an electrical conductor which is placed in the conductor-receiving chamber is pressed into the said conductor-receiving chamber by the said clamping screw when the latter is screwed in, the insulation displacement terminal severing the sheathing of the electrical conductor and the said conductor making contact electrically with the insulation displacement terminal.

The advantages obtained with the invention consist, in particular, in the fact that a conductor-connecting element with an insulation displacement arrangement of double design can be loaded with substantially higher current intensities, the said insulation displacement terminals being disposed symmetrically to the clamping screw which is disposed centrally between them.

Furthermore, insulation displacement-type contact-making guarantees more reliable electrical contact-making, which requires only low actuating forces, even in the case of fairly large cable cross-sections.

In addition, because of the open type of construction of the conductor-connecting element, in which the point of contact-making can be directly inspected, a simple visual check concerning the state of contact-making between the insulation displacement terminal and the electrical conductor is of advantage.

An advantageous further development of the invention results from the use of a clamping screw with a pressure piece which does not rotate and which presses the electrical conductor into the insulation displacement terminals, the frictional forces on the sheathing of the electrical conductor which otherwise still additionally occur because of the rotating clamping screw, being avoided.

Figure 1B:
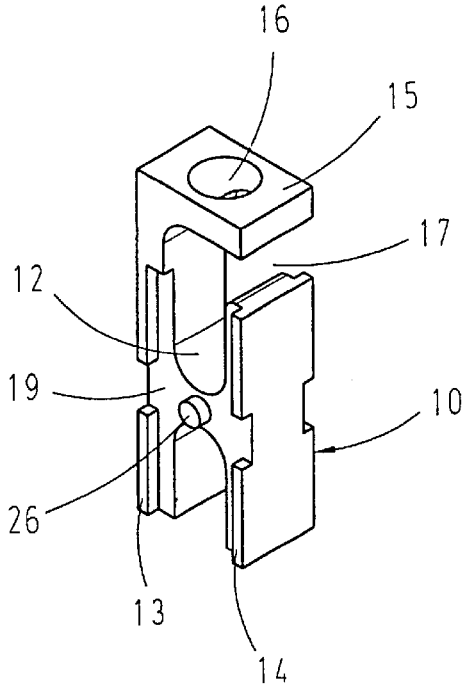
Figure 1C:
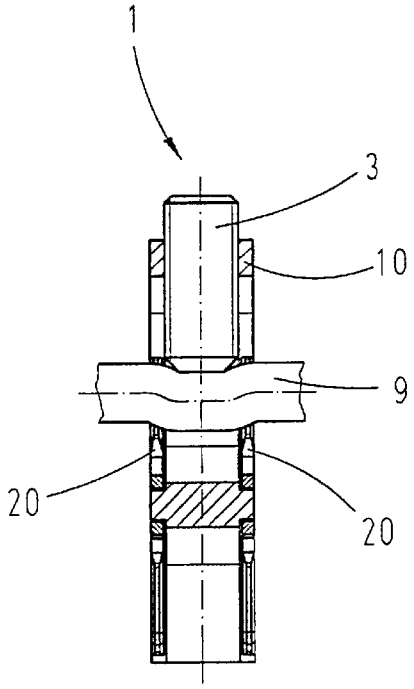
Figure 2:
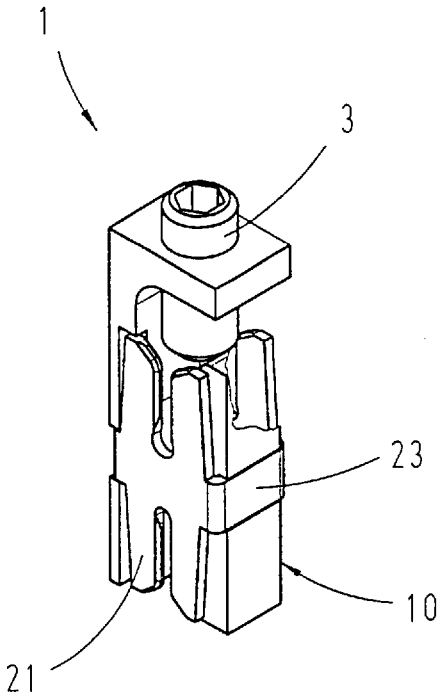
Figure 3:
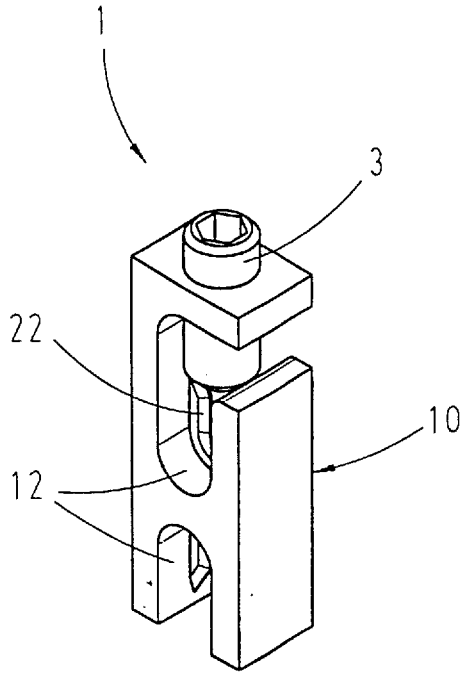
Figure 4:
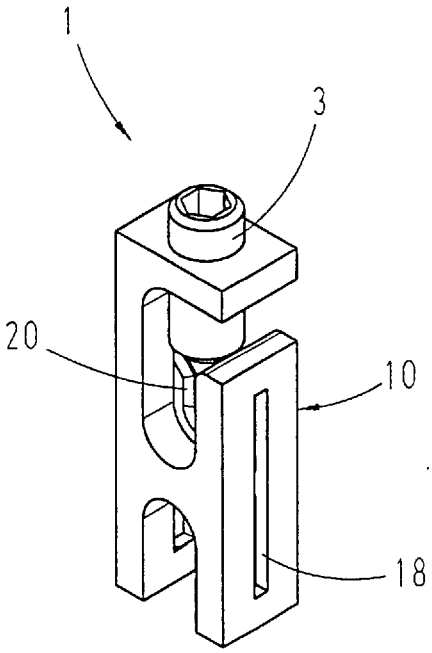
Figure 5:
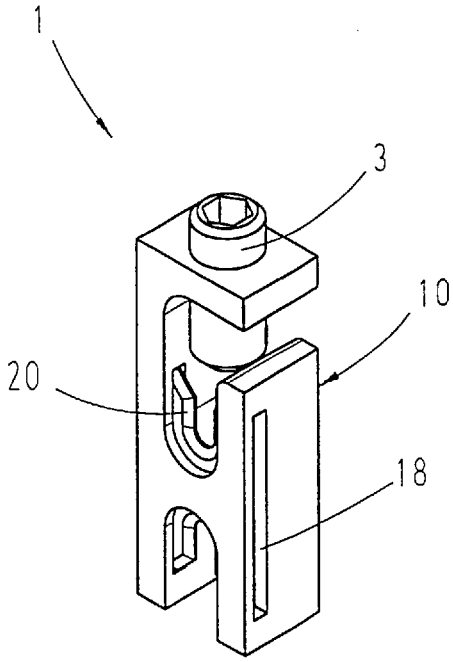
Figure 6:
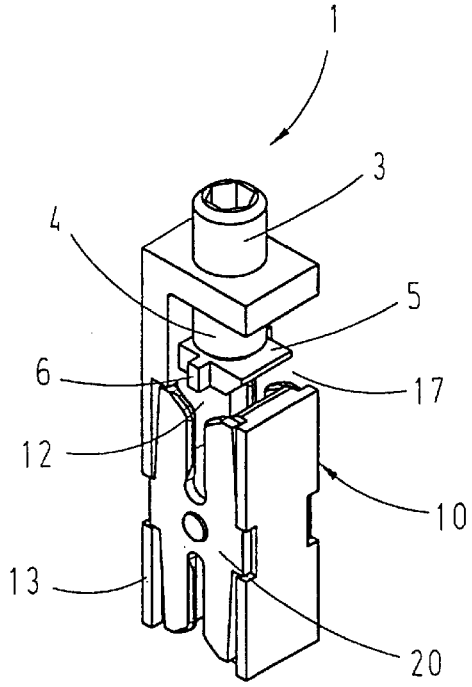
Figure 7:
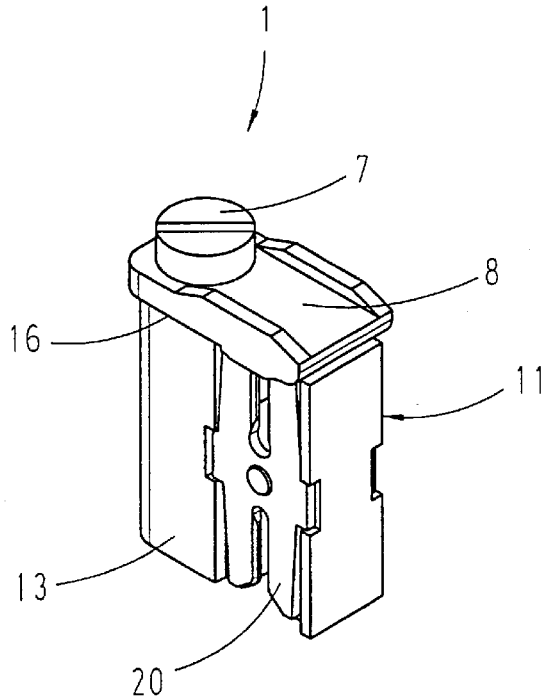

An exemplified embodiment of the invention is represented in the drawings and will be explained in greater detail below. In the said drawings:

FIG. 1*a* shows a perspective view of a conductor-connecting element with insulation displacement terminals, FIG. 1*b* shows a perspective view of a carrier body belonging to a conductor-connecting element, FIG. 1*c* shows a section through a conductor-connecting element with an electrical conductor, FIG. 2 shows a perspective view of a conductor-connecting element with double insulation displacement terminals, FIG. 3 shows a perspective view of a conductor-connecting element with an integrated insulation displacement terminal, FIG. 4 shows a perspective view of a conductor-connecting element with a centrally disposed insulation displacement terminal, FIG. 5 shows a perspective view of a conductor-connecting element with an eccentrically disposed insulation displacement terminal, FIG. 6 shows a perspective view of a conductor-connecting element with a clamping screw provided with a pressure piece, and FIG. 7 shows a perspective view of a conductor-connecting element with a pressure cap.

An electrically conductive conductor-connecting element 1 with insulation displacement contacts 20 which are engaged in a latching manner in a connecting body 10, is shown in a perspective view in FIG. 1*a* in the form of a double or two-sided conductor connection, the upper half being provided with a screw connection while the lower half in this example is provided only with an open insulation displacement connection.

The conductor-connecting element may also be intended, in different variants of the second (in this case, lower) connection, for a busbar, as a crimp connection, as a simple screw connection or for soldering-in.

The connecting body 10 is formed by two legs 13 and 14 which are connected to one another centrally, the legs and a formed-on portion 15 attached to the leg 13 at right angles forming a conductor-receiving chamber 12 in which an electrical conductor 9 can be inserted through an opening 17.

The connecting body 10 of H-shaped construction is shown in the example in FIG. 1*b*, a central threaded bore 16 being disposed in the formed-on portion 15.

Also provided in each of the narrow sides of the legs is a recessed clearance 19 which has a central peg 26 in the region connecting the two legs. An insulation displacement terminal 20 with a corresponding bore 25 for the peg 26 can be inserted in a clamping manner in each of the said clearances.

The rounded inner contours of the conductor-receiving chamber 12 are adapted to the round shape of the electrical conductors 9, while the outer contour has the elongated, rectangularly designed shape of the connecting body.

Screwed, as shown in figure 1*a*, into the central threaded bore 16 in the formed-on portion 15 is a clamping screw 3 which is held in a captive manner in the region of the conductor-receiving chamber by means of a latched-on plastic sleeve 4.

The end of the plastic sleeve 4 is moved higher or lower in the conductor-receiving chamber 12, according to the direction of rotation of the clamping screw 3. Two individual insulation displacement terminals 20 are engaged in a latching manner in the carrier body 10 on either side of the clamping screw by means of rectangular latching noses 24 which are formed on at the lateral outer edges of the said terminals and which engage in the clearances 19. For further use, the complete conductor-connecting element is put into a correspondingly shaped clearance in an insulating carrier housing which is not shown here, it being possible to arrange a number of conductor-connecting elements in a row in one carrier housing.

For contact-making between a conductor-connecting element 1 and an electrical conductor, the latter is pushed into the opening 17, into the conductor-receiving chamber 12 and into the region between the insulation displacement terminals 20. The clamping screw 3 is then turned with a suitable tool in the direction of the insulation displacement terminals, so that the electrical conductor 9 is forced between the insulation displacement terminals 20 on either side of the clamping screw, the sheathing of the conductor being cut into by each of the two insulation displacement terminals and a double electrical contact between the conductor and the insulation displacement terminals being ensured, so that even high currents can be conducted via this contact-making system.

The way in which an electrical conductor 9 is pressed by the clamping screw 3 into the cutting edges of two insulation displacement terminals 20 is shown in FIG. 1*c*, in a longitudinal section through a conductor-connecting element 1.

FIG. 2 shows, in a variant to FIG. 1*a*, a conductor-connecting element which is otherwise of identical construction but in which two insulation displacement terminals are connected to one another by means of a bridge-like web 23 to form a one-piece, double insulation displacement terminal 21.

On either side of the web, the insulation displacement terminals are bent over in a U-shaped manner and latched onto the connecting body 10 of the conductor-connecting element in corresponding clearances 19.

FIG. 3 shows a conductor-connecting element which preferably has an insulation displacement terminal 22 which is disposed centrally in relation to the clamping screw 3. In this case, the insulation displacement terminal is machined out of the material of the connecting body 10.

FIG. 4 shows, in a variant of FIG. 3, a conductor-connecting element which likewise has an insulation displacement terminal which is disposed centrally in relation to the clamping screw 3 but which is inserted centrally in the connecting body 10, as a separate insulation displacement terminal 20, through a central slit 18.

FIG. 5 shows, in a variant to FIG. 4, a conductor-connecting element whose insulation displacement terminal has an eccentric location in relation to the clamping screw 3, the said insulation displacement terminal 20 likewise being inserted in a slit 18 in the connecting body 10 of the conductor-connecting element.

FIG. 6 shows a conductor-connecting element in which two individual insulation displacement terminals 20 are provided, as in FIG. 1, but in which the clamping screw 3 has a variant.

Provided in the conductor-receiving chamber 12, underneath the end of the clamping screw, is a rectangular pressure piece 5 which is rotatably attached, preferably by means of a rivet-like fastening, to the end of the said clamping screw 3.

Because of the abutment of part of the pressure piece against the inner wall of the leg 13, the said pressure piece remains in the intended position-apart from a vertical displacement—irrespective of the rotation of the clamping screw.

The pressure piece 5 also has, on that side which faces towards the opening 17 in the connecting body 10, a lower bevel in order to facilitate the insertion of an electrical conductor in the conductor-receiving chamber 12 at the insulation displacement terminals 20.

In addition, there are formed on, on the two sides of the pressure piece which point towards the insulation displacement terminals, noses 6 which are guided in the slits between the insulation displacement terminals 20 as the electrical conductor is increasingly forced into the latter, thereby achieving an additional safeguard against twisting.

As a result of using the pressure piece 5, which does not co-rotate with the clamping screw 3, friction of the said clamping screw 3 on the sheathing during rotation is avoided and, at the same time, the contact pressure is distributed over a larger area of the electrical conductor.

FIG. 7 shows another variant of the conductor-connecting element, in which the clamping screw 7 is screwed into a threaded bore 16 in one leg 13, which is of enlarged construction, of the carrier body 11, a pressure cap 8 being lowered, by means of the clamping screw, onto an electrical conductor (9) disposed between the insulation displacement terminals 20, and forcing the said conductor between the cutting edges.

What is claimed is:

1. A conductor-connecting element for the connection of electrical conductors, comprising a connecting body having a U-shaped conductor-receiving chamber, a threaded bore into which a clamping screw can be screwed provided in the connecting body, the connecting body being provided with at least one insulation displacement terminal, wherein the insulation displacement terminal has: (1) latching noses formed on longitudinal sides thereof which can be inserted in clearances on the connecting body; and (2) a central opening for a peg on the connecting body, by means of which peg the insulation displacement terminal is held, whereby when an electrical conductor is placed in the conductor-receiving chamber and pressed into the conductor-receiving chamber by the clamping screw when the clamping screw is screwed in, the insulation displacement terminal severs sheathing of the electrical conductor and the conductor makes contact electrically with the insulation displacement terminal.

2. The conductor-connecting element according to claim 1, wherein the insulation displacement terminal is disposed in the conductor-receiving chamber, centrally in relation to the clamping screw.

3. The conductor-connecting element according to claim 1, wherein the insulation displacement terminal is disposed eccentrically in the conductor-receiving chamber, laterally next to the clamping screw.

4. The conductor-connecting element according to claim 1, wherein one insulation displacement terminal in each case is disposed at lateral openings of the conductor-receiving chamber.

5. The conductor-connecting element according to claim 1, and comprising two insulation displacement terminals connected to one another by means of a web and engagable in a latching manner, as a double insulation displacement terminal bent in an U-shaped manner, on said carrier body.

6. The conductor-connecting element according to claim 1, wherein the connecting body has, longitudinally through legs, at least one slit in which the insulation displacement terminal can be inserted in the conductor-receiving chamber.

7. The conductor-connecting element according to claim 1, wherein the connecting body and the insulation displacement terminal are constructed in one piece.

8. The conductor-connecting element according to claim 1, wherein the clamping screw is provided, at a front end thereof, with a pressure piece which points in a direction of the conductor-receiving chamber and is held in a rotatable manner, there being provided on the pressure piece noses which project laterally outwards and project into slits in the insulation displacement terminals.

9. The conductor-connecting element according to claim 1, wherein a pressure cap is provided which extends over the conductor-receiving chamber and presses the electrical conductor into insulation displacement terminals when the clamping screw is screwed in a threaded bore in a leg of the connecting body in the direction of the insulation displacement terminals.

10. The conductor-connecting element according to claim 1, wherein the conductor-connecting element is constructed as a double-sided connecting element, a one-piece connecting body being formed from two opposing U-shaped conductor-receiving chambers for receiving an electrical conductor in each case.

11. The conductor-connecting element according to claim 1, wherein the threaded bore is provided in a formed-on portion of the connecting body, which formed-on portion extends above the conductor-receiving chamber.

12. The conductor-connecting element according to claim 11, wherein the insulation displacement terminal is disposed in the conductor-receiving chamber, centrally in relation to the clamping screw.

13. The conductor-connecting element according to claim 11, wherein the insulation displacement terminal is disposed eccentrically in the conductor-receiving chamber, laterally next to the clamping screw.

14. The conductor-connecting element according to claim 11, wherein one insulation displacement terminal in each case is disposed at lateral openings of the conductor-receiving chamber.

15. The conductor-connecting element according to claim 11, wherein the insulation displacement terminal has latching noses which are formed on longitudinal sides thereof for insertion in clearances on the connecting body, and the insulation displacement terminal has a central opening for a peg on the connecting body, by means of which peg the insulation displacement terminal is held.

16. A conductor-connecting element for the connection of electrical conductors, comprising a connecting body having a U-shaped conductor-receiving chamber, a threaded bore into which a clamping screw can be screwed provided in the connecting body, the connecting body being provided with at least one insulation displacement terminal, wherein the clamping screw is provided, at a front end thereof, with a pressure piece which points in a direction of the conductor-receiving chamber and is held in a rotatable manner, there being provided on the pressure piece noses which project laterally outwards and project into slits in the insulation displacement terminals, and whereby when an electrical conductor is placed in the conductor-receiving chamber and pressed into the conductor-receiving chamber by the clamping screw when the clamping screw is screwed in, the insulation displacement terminal severs sheathing of the electrical conductor and the conductor makes contact electrically with the insulation displacement terminal.

17. The conductor-connecting element according to claim 16, wherein the threaded bore is provided in a formed-on portion of the connecting body, which formed-on portion extends above the conductor-receiving chamber.

18. The conductor-connecting element according to claim 16, wherein the insulation displacement terminal is disposed in the conductor-receiving chamber, centrally in relation to the clamping screw.

19. The conductor-connecting element according to claim 16, wherein the insulation displacement terminal is disposed eccentrically in the conductor-receiving chamber, laterally next to the clamping screw.

20. The conductor-connecting element according to claim 16, wherein one insulation displacement terminal in each case is disposed at lateral openings of the conductor-receiving chamber.

21. The conductor-connecting element according to claim 16, and comprising insulation displacement terminals connected to one another by means of a web and engagable in a latching manner, as a double insulation displacement terminal bent in a U-shaped manner, on said carrier body.

22. The conductor-connecting element according to claim 16, wherein the connecting body has, longitudinally through legs, at least one slit in which the insulation displacement terminal can be inserted in the conductor-receiving chamber.

23. The conductor-connecting element according to claim 16, wherein the connecting body and the insulation displacement terminal are constructed in one piece.

24. The conductor-connecting element according to claim 16, wherein a pressure cap is provided which extends over the conductor-receiving chamber and presses the electrical conductor into insulation displacement terminals when the clamping screw is screwed in a threaded bore in a leg of the connecting body in the direction of the insulation displacement terminals.

25. The conductor-connecting element according to claim 16, wherein the conductor-connecting element is constructed as a double-sided connecting element, a one-piece connecting body being formed from two opposing U-shaped conductor-receiving chambers which are designed for receiving an electrical conductor in each case.

26. The conductor-connecting element according to claim 16, wherein the insulation displacement terminal is disposed in the conductor-receiving chamber, centrally in relation to the clamping screw.

27. The conductor-connecting element according to claim 16, wherein the insulation displacement terminal is disposed eccentrically in the conductor-receiving chamber, laterally next to the clamping screw.

28. The conductor-connecting element according to claim 16, wherein one insulation displacement terminal in each case is disposed at lateral openings of the conductor-receiving chamber.

29. The conductor-connecting element according to claim 16, wherein the insulation displacement terminal has latching noses which are formed on longitudinal sides thereof for insertion in clearances on the connecting body, and the insulation displacement terminal has a central opening for a peg on the connecting body, by means of which peg the insulation displacement terminal is held.

30. A conductor-connecting element for the connection of electrical conductors, comprising a connecting body having a U-shaped conductor-receiving chamber, a threaded bore into which a clamping screw can be screwed provided in the connecting body, the connecting body being provided with at least one insulation displacement terminal, wherein the threaded bore is provided in a formed-on portion of the connecting body, which formed-on portion extends above the conductor-receiving chamber, and the insulation displacement terminal has: (1) latching noses which are formed on longitudinal sides thereof which can be inserted in clearances on the connecting body; and (2) a central opening for a peg on the connecting body, by means of which peg the said insulation displacement terminal is held, and whereby when an electrical conductor is placed in the conductor-receiving chamber and pressed into the conductor-receiving chamber by the clamping screw when the clamping screw is screwed in, the insulation displacement terminal severs sheathing of the electrical conductor and the conductor makes contact electrically with the insulation displacement terminal.

31. The conductor-connecting element according to claim 30, wherein the insulation displacement terminal is disposed in the conductor-receiving chamber, centrally in relation to the clamping screw.

32. The conductor-connecting element according to claim 30, wherein the insulation displacement terminal is disposed eccentrically in the conductor-receiving chamber, laterally next to the clamping screw.

33. The conductor-connecting element according to claim 30, wherein one insulation displacement terminal in each case is disposed at lateral openings of the conductor-receiving chamber.

34. The conductor-connecting element according to claim 30, and comprising two insulation displacement terminals connected to one another by means of a web and engagable in a latching manner, as a double insulation displacement terminal bent in a U-shaped manner, on said carrier body.

35. The conductor-connecting element according to claim 30, wherein the connecting body has, longitudinally through legs, at least one slit in which the insulation displacement terminal can be inserted in the conductor-receiving chamber.

36. The conductor-connecting element according to claim 30, wherein the connecting body and the insulation displacement terminal are constructed in one piece.

37. The conductor-connecting element according to claim 30, wherein a pressure cap is provided which extends over the conductor-receiving chamber and presses the electrical conductor into insulation displacement terminals when the clamping screw is screwed in a threaded bore in a leg of the connecting body in the direction of the insulation displacement terminals.

38. The conductor-connecting element according to claim 30, wherein the conductor-connecting element is constructed as a double-sided connecting element, a one-piece connecting body being formed from two opposing U-shaped conductor-receiving chambers designed for receiving an electrical conductor in each case.

39. A conductor-connecting element for the connection of electrical conductors, comprising a connecting body having a U-shaped conductor-receiving chamber, a threaded bore into which a clamping screw can be screwed provided in the connecting body, the connecting body being provided with at least one insulation displacement terminal, wherein the threaded bore is provided in a formed-on portion of the connecting body, which formed-on portion extends above the conductor-receiving chamber, wherein the clamping screw is provided, at a front end thereof, with a pressure piece which points in the direction of the conductor-receiving chamber and is held in a rotatable manner, there being provided on the pressure piece noses which project laterally outwards and project into slits in the insulation displacement terminal, and whereby when an electrical conductor is placed in the conductor-receiving chamber and pressed into the conductor-receiving chamber by the clamping screw when the clamping screw is screwed in, the insulation displacement terminal severs sheathing of the electrical conductor and the conductor makes contact electrically with the insulation displacement terminal.

40. The conductor-connecting element according to claim 39, wherein the insulation displacement terminal is disposed in the conductor-receiving chamber, centrally in relation to the clamping screw.

41. The conductor-connecting element according to claim 39, wherein the insulation displacement terminal is disposed eccentrically in the conductor-receiving chamber, laterally next to the clamping screw.

42. The conductor-connecting element according to claim 39, wherein one insulation displacement terminal in each case is disposed at lateral openings of the conductor-receiving chamber.

43. The conductor-connecting element according to claim 39, and comprising two insulation displacement terminals connected to one another in one piece by means of a web and engagable in a latching manner, as a double insulation displacement terminal bent in a U-shaped manner, on said carrier body.

44. The conductor-connecting element according to claim 39, wherein the connecting body has, longitudinally through legs, at least one slit in which the insulation displacement terminal can be inserted in the conductor-receiving chamber.

45. The conductor-connecting element according to claim 39, wherein the connecting body and the insulation displacement terminals are constructed in one piece.

46. The conductor-connecting element according to claim 39, wherein a pressure cap is provided which extends over the conductor-receiving chamber, and presses the electrical conductor into insulation displacement terminals when the clamping screw is screwed in a threaded bore in a leg of the connecting body in the direction of the insulation displacement terminals.

47. The conductor-connecting element according to claim 39, wherein the conductor-connecting element is constructed as a double-sided connecting element, a one-piece connecting body being formed from two opposing U-shaped conductor-receiving chambers which are intended for receiving an electrical conductor in each case.

* * * * *